US009395700B2

(12) United States Patent
Oshita et al.

(10) Patent No.: US 9,395,700 B2
(45) Date of Patent: Jul. 19, 2016

(54) ELECTRONIC DEVICE, COMPUTER READABLE RECORDING MEDIUM AND DATE AND TIME INFORMATION OBTAINING METHOD

(71) Applicant: CASIO COMPUTER CO., LTD., Shibuya-ku, Tokyo (JP)

(72) Inventors: Yuki Oshita, Tokyo (JP); Kosuke Hasegawa, Fussa (JP); Takeshi Matsue, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/560,905

(22) Filed: Dec. 4, 2014

(65) Prior Publication Data

US 2015/0185705 A1 Jul. 2, 2015

(30) Foreign Application Priority Data

Dec. 26, 2013 (JP) ..... 2013-268841
Oct. 8, 2014 (JP) ..... 2014-207038

(51) Int. Cl.
*G04R 20/02* (2013.01)
*G04R 20/04* (2013.01)

(52) U.S. Cl.
CPC ..... *G04R 20/04* (2013.01); *G04R 20/02* (2013.01)

(58) Field of Classification Search
CPC ..... G04R 20/00; G04R 20/02; G04R 20/04; G04R 20/06; G04R 20/08; G04R 20/14
USPC ..... 368/47
See application file for complete search history.

(56) References Cited

U.S. PATENT DOCUMENTS 7,190,307 B2 * 3/2007 Gronemeyer ..... G01S 19/235 342/357.69
2007/0241959 A1 * 10/2007 Nakagawa ..... G01S 19/27 342/357.66
2008/0175105 A1 * 7/2008 Urano ..... G01S 19/14 368/47
2009/0129206 A1 * 5/2009 Baba ..... G01S 19/34 368/14
2009/0180356 A1 * 7/2009 Fujisawa ..... G01S 19/14 368/47
2011/0051559 A1 * 3/2011 Oh ..... G04G 9/0076 368/10
2011/0063952 A1 * 3/2011 Baba ..... G04G 5/002 368/47

(Continued)

FOREIGN PATENT DOCUMENTS

JP 2001051077 A 2/2001
JP 2002071854 A 3/2002

*Primary Examiner* — Amy Cohen Johnson
*Assistant Examiner* — Matthew Powell
(74) *Attorney, Agent, or Firm* — Holtz, Holtz & Volek PC

(57) ABSTRACT

An electronic device includes a clocking unit; a receiving unit; a reception control unit; and a date and time obtaining unit. The reception control unit makes the receiving unit receive first date and time information which is transmitted from a positioning satellite, the first date and time information indicating an elapsed time from a start of a week to an end of the week, and the reception control unit does not make the receiving unit receive second date and time information which is transmitted from the positioning satellite, the second date and time information indicating a week number. The date and time obtaining unit calculates an uncorrected date and time based on the first date and time information and a clocking unit week number which is a week number calculated from date and time counted by the clocking unit.

20 Claims, 12 Drawing Sheets

(56) References Cited

U.S. PATENT DOCUMENTS

2012/0257479 A1* 10/2012 Fujisawa ..... G01S 19/14 368/47

2014/0226446 A1* 8/2014 Kato ..... G04R 20/04 368/34

* cited by examiner

FIG.4A

| CLOCKED UTC DATE AND TIME | CLOCKED GPS DATE AND TIME | OBTAINED TOW | OUTPUT GPS DATE AND TIME | OUTPUT UTC DATE AND TIME |
|---|---|---|---|---|
| BEFORE SAT 23:59:38 | BEFORE SAT 23:59:54 | 3 TO 14403 | AFTER SUN 00:00:16 | AFTER SUN 00:00:00 |
| INPUT DATE WN=n | CALCULATED WN=n | | CORRECT WN=n+1 | OUTPUT DATE WN=n |

FIG.4B

| CLOCKED UTC DATE AND TIME | CLOCKED GPS DATE AND TIME | OBTAINED TOW | OUTPUT GPS DATE AND TIME | OUTPUT UTC DATE AND TIME |
|---|---|---|---|---|
| AFTER SUN 00:00:00 | AFTER SUN 00:00:16 | 86403 TO 100799 | BEFORE SAT 23:59:54 | BEFORE SAT 23:59:38 |
| INPUT DATE WN=n | CALCULATED WN=n | | CORRECT WN=n−1 | OUTPUT DATE WN=n |

FIG.4C

| CLOCKED UTC DATE AND TIME | CLOCKED GPS DATE AND TIME | OBTAINED TOW | OUTPUT GPS DATE AND TIME | OUTPUT UTC DATE AND TIME |
|---|---|---|---|---|
| BEFORE SAT 23:59:38 | BEFORE SAT 23:59:54 | 0 TO 3 | AFTER SAT 23:59:57 BEFORE SUN 00:00:16 | AFTER SAT 23:59:41 BEFORE SAT 24:00:00 |
| INPUT DATE WN=n | CALCULATED WN=n | | CORRECT WN=n+1 | OUTPUT DATE WN=n−1 |

FIG.4D

| CLOCKED UTC DATE AND TIME | CLOCKED GPS DATE AND TIME | OBTAINED TOW | OUTPUT GPS DATE AND TIME | OUTPUT UTC DATE AND TIME |
|---|---|---|---|---|
| AFTER SAT 23:59:38 BEFORE SAT 24:00:00 | AFTER SAT 23:59:54 BEFORE SUN 00:00:16 | 86403 TO 100799 | AFTER SUN 00:00:16 BEFORE SAT 23:59:54 | AFTER SAT 00:00:00 BEFORE SAT 23:59:38 |
| INPUT DATE WN=n | CALCULATED WN=n+1 | | CORRECT WN=n | OUTPUT DATE WN=n+1 |

FIG.6

| OUTPUT / INPUT | SUN | MON | TUE | WED | THU | FRI | SAT |
|---|---|---|---|---|---|---|---|
| SUN | ○ | ○ | × | × | × | × | -7 DAYS |
| MON | ○ | ○ | ○ | × | × | × | × |
| TUE | × | ○ | ○ | ○ | × | × | × |
| WED | × | × | ○ | ○ | ○ | × | × |
| THU | × | × | × | ○ | ○ | ○ | × |
| FRI | × | × | × | × | ○ | ○ | ○ |
| SAT | +7 DAYS | × | × | × | × | ○ | * |

FIG.8

| OUTPUT / INPUT | SUN | MON | TUE | WED | THU | FRI | SAT |
|---|---|---|---|---|---|---|---|
| SUN | ○ | ○ | × | × | × | × | -7 DAYS |
| MON | ○ | ○ | ○ | × | × | × | × |
| TUE | × | ○ | ○ | ○ | × | × | × |
| WED | × | × | ○ | ○ | ○ | × | × |
| THU | × | × | × | ○ | ○ | ○ | × |
| FRI | × | × | × | × | ○ | ○ | ○ |
| SAT | +7 DAYS | × | × | × | × | ○ | ○ |

ELECTRONIC DEVICE, COMPUTER READABLE RECORDING MEDIUM AND DATE AND TIME INFORMATION OBTAINING METHOD

BACKGROUND OF THE INVENTION

1. Field of the Invention

The present invention relates to an electronic device which obtains date and time information from outside, a computer readable recording medium and a date and time information obtaining method.

2. Description of Related Art

A technique for appropriately obtaining highly accurate date and time information by combining a plurality of date and time information obtaining methods is described in Japanese Patent Application Laid Open Publication No. 2002-71854 which is a Japanese patent document, for example.

However, there is a problem that a technique for obtaining date and time information by receiving a transmitted radio wave from a positioning satellite consumes an extremely large amount of electric power compared to other date and time information obtaining methods and increases the load on electronic devices.

An object of the present invention is to provide an electronic device, a computer readable recording medium and a date and time information obtaining method that can obtain information necessary for obtaining an accurate date and time from a positioning satellite while suppressing the increase in power consumption.

SUMMARY OF THE INVENTION

In order to solve the above object, there is provided an electronic device, including: a clocking unit which counts a date and time; a receiving unit which receives a transmitted radio wave from a positioning satellite; a reception control unit which controls a reception period by the receiving unit; and a date and time obtaining unit which obtains a date and time from the received transmitted radio wave, wherein among first date and time information of a first time unit transmitted from the positioning satellite and second date and time information of a second time unit which has a unit width larger than a unit width of the first time unit, the reception control unit makes the receiving unit receive only the first date and time information, and the date and time obtaining unit includes: a date and time calculation unit which, on the basis of internal date and time information of the second time unit calculated from the date and time of the clocking unit and the first date and time information received by the receiving unit, calculates a date and time within a range according to the internal date and time information; and a date and time correction unit which corrects the calculated date and time on the basis of a difference between the date and time calculated by the date and time calculation unit and the date and time counted by the clocking unit.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 4A is a diagram showing a pattern of a case where a large gap is generated between input and output dates;

FIG. 4B is a diagram showing a pattern of a case where a large gap is generated between input and output dates;

FIG. 4C is a diagram showing a pattern of a case where a large gap is generated between input and output dates;

FIG. 4D is a diagram showing a pattern of a case where a large gap is generated between input and output dates;

FIG. 6 is a diagram showing processing contents of the date and time obtaining processing in the first embodiment with respect to a day of the week of a clocking circuit input to a GPS reception processing unit and output from the GPS reception processing unit;

FIG. 8 is a diagram showing processing contents of date and time obtaining processing in the second embodiment with respect to a day of the week of clocking circuit input to the GPS reception processing unit and output from the GPS reception processing unit;

DETAILED DESCRIPTION OF THE PREFERRED EMBODIMENT

Hereinafter, an embodiment of the present invention will be described with reference to the drawings.

[First Embodiment]

First, an electronic device in a first embodiment will be described.

Figure 1:
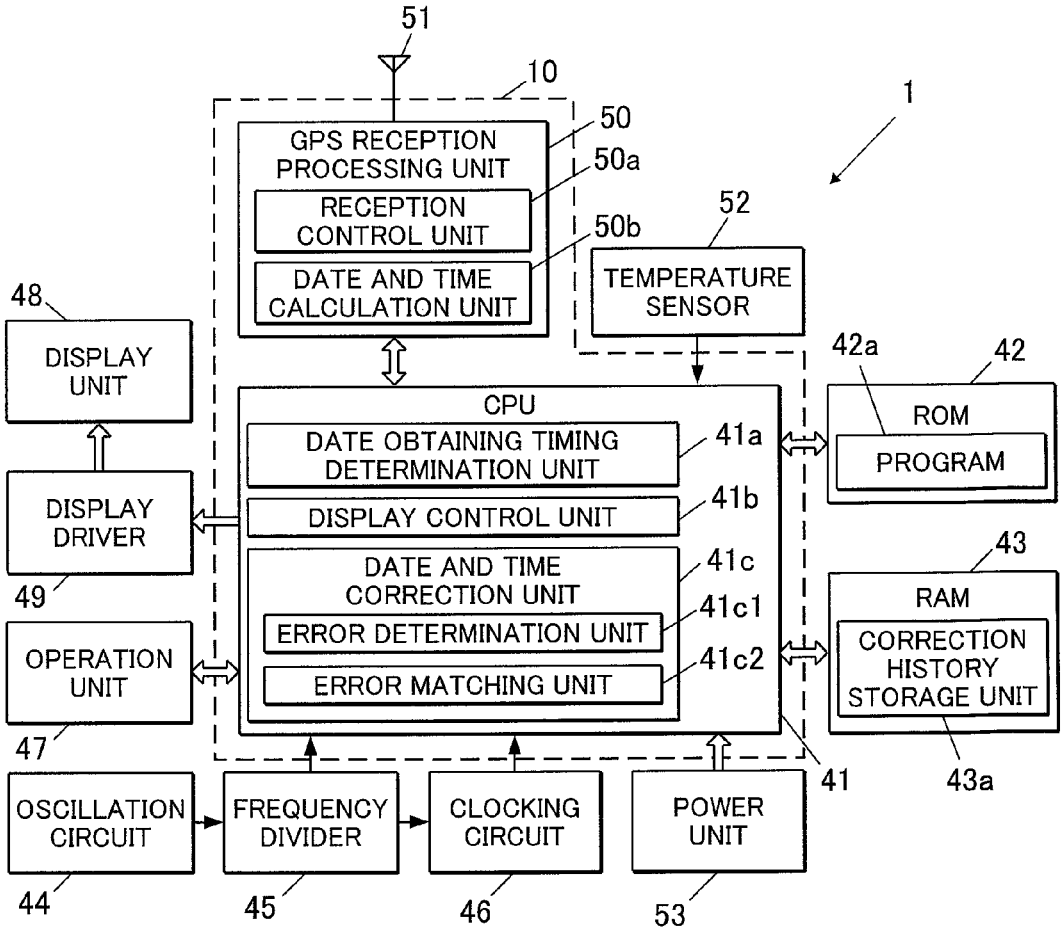
FIG. 1 is a block diagram showing an internal configuration of an electronic device in a first embodiment of the present invention.

FIG. 1 is a block diagram showing an internal configuration of an electronic timepiece 1 which is the first embodiment of the electronic device according to the present invention.

The electronic timepiece 1 includes a CPU (Central Processing Unit) 41 (date obtaining timing determination unit 41*a*, display control unit 41*b* and date and time correction unit 41*c*), a ROM (Read Only Memory) 42, a RAM (Random Access Memory) 43, an oscillation circuit 44, a frequency divider 45, a clocking circuit 46 (clocking unit), an operation unit 47, a display unit 48, a display driver 49, a GPS reception processing unit 50, an antenna thereof 51, a temperature sensor 52, a power supply unit 53 and such like. Each of the date obtaining timing determination unit 41*a*, display control unit 41*b* and date and time correction unit 41*c* may be a different CPU 41.

The CPU 41 performs various types of arithmetic processing and integrally controls the entire operation of the electronic timepiece 1. The CPU 41 reads out the current date and time data in the clocking circuit 46, displays the data on the display unit 48, obtains date and time data by executing a program 42*a* and operating the GPS reception processing unit 50 and corrects the date and time counted by the clocking circuit 46 on the basis of the obtained data.

The ROM 42 stores various programs for control and initial setting data. The programs to be stored in the ROM 42 include the program 42*a* according to the processing for correcting the current date and time counted by the clocking circuit 46.

The RAM 43 provides a working memory space to the CPU 41 and stores working data and various types of setting data. The RAM 43 includes a correction history storage unit 43*a* (history storage unit) and stores information according to the last date and time correction history.

The oscillation circuit 44 generates and outputs a predetermined frequency signal. The oscillation circuit 44 includes a crystal oscillator, for example.

The frequency divider 45 divides the predetermined frequency signal input from the oscillation circuit 44 into respective frequency signals used by the CPU 41 and the clocking circuit 46 and outputs the respective signals.

The clocking circuit 46 counts current date and time. The clocking circuit 46 is a counter which maintains current date and time data by counting a clock signal input from the frequency divider 45 and adding the counted number to the initial value of date and time. The value to be counted by the clocking circuit 46 may be a value corresponding to an elapsed time from a specific reference timing or may be a value in a date and time form (year, month, day, hour, minute, second) by UTC (Coordinated Universal Time) or the like. The initial value of the clocking circuit 46 is set with reference to RTC (Real Time Clock) not shown in the drawings when the power is turned on, and the value is overwritten to be corrected by the CPU 41 in accordance with the execution of the program 42*a* according to the date and time correction.

The date and time counted by the clocking circuit 46 includes a clocking error (rate) corresponding to the frequency error of frequency signal which is generated by the crystal oscillator of the oscillation circuit 44. The clocking error of clocking circuit 46 by the crystal oscillator in the oscillation circuit 44 used in a normal electronic timepiece 1 is approximately 15 seconds per month, for example.

The operation unit 47 receives an input operation by a user and outputs an electric signal as an input signal to the CPU 41. The operation unit 47 includes one or a plurality of push button switch, crown, touch sensor and the like, and an electric signal corresponding to operation contents is generated by detecting various operations such as pressing down, rotation and touch which are determined in advance for the push button switch, crown, touch sensor and the like, respectively.

Though not especially limited, the display unit 48 includes a digital display screen, and performs display according to various functions which are executable by the electronic timepiece 1 in addition to the current date and time selectively or in parallel. A liquid crystal display (LCD) is used as the display screen, for example, and a liquid crystal driver which drives the LCD is used as the display driver 49. The display driver 49 outputs a drive signal of LCD to the LCD on the basis of the control signal input from the CPU 41. Alternatively, the display unit 48 may include one or a plurality of hands in addition to or instead of the digital display screen so that the hands are rotated by the rotation of stepping motor driven by a driving circuit to enable analog display of a part or all of the date, time and status.

The display unit 48 and the display driver 49 form a notification unit.

The GPS reception processing unit 50 receives radio waves from one or a plurality of positioning satellites, here, positioning satellites according to GPS (hereinafter, called GPS satellite) by using the antenna 51 and obtains date and time information. Here, the date and time information is information which is a value corresponding to a date and time (GPS date and time) counted by an internal clock of GPS satellite (GPS clock) and information accompanying it. After performing after-mentioned processing on the basis of delay or the like due to the transmission time with respect to the value, the GPS reception processing unit 50 converts the value into a UTC date and time and outputs the converted value.

The GPS reception processing unit 50 includes a receiving circuit (front end) for radio waves of L1 band (1.57542 GHz in GPS satellite) and a baseband unit for obtaining information regarding date and location by decoding a signal which is received and demodulated. The baseband unit includes a microcomputer (reception control unit 50*a* and date and time calculation unit 50*b*) which has a CPU for operation control, a RAM and a nonvolatile memory, and the microcomputer receives a control instruction from the CPU 41 and controls operations of the GPS reception processing unit 50. The baseband unit searches for a receivable satellite among the plurality of GPS satellites, tunes to the received frequency of the GPS satellite, and identifies a C/A code (pseudo random code) for decoding. The GPS reception processing unit 50 demodulates and decodes transmitted radio waves from the received GPS satellite to obtain date and time data, and outputs the data to the CPU 41 in a set format.

The GPS reception processing unit 50 and the antenna 51 form a receiving unit.

The GPS reception processing unit 50 uses date and time information which is set and input in advance, and can calculate the current date and time by complementing the date and time obtained from a part of the received navigation message data. The detailed calculation method will be described later.

The CPU 41 and the GPS reception processing unit 50 form a date and time obtaining unit 10.

The temperature sensor 52 measures an ambient temperature. An IC tip sensor which is normally used can be used as the temperature sensor 52, and the temperature sensor 52 may be formed on the same chip together with the CPU 41, ROM 42 and RAM 43.

The power supply unit 53 supplies electric power to units in the electronic timepiece 1. The power supply unit 53 has a battery such as a button-type or disc-like primary cell, for example, and the primary cell is detachable to be replaced as needed.

Next, the operation of date and time correction in the electronic timepiece 1 in the embodiment will be described.

Figure 2:
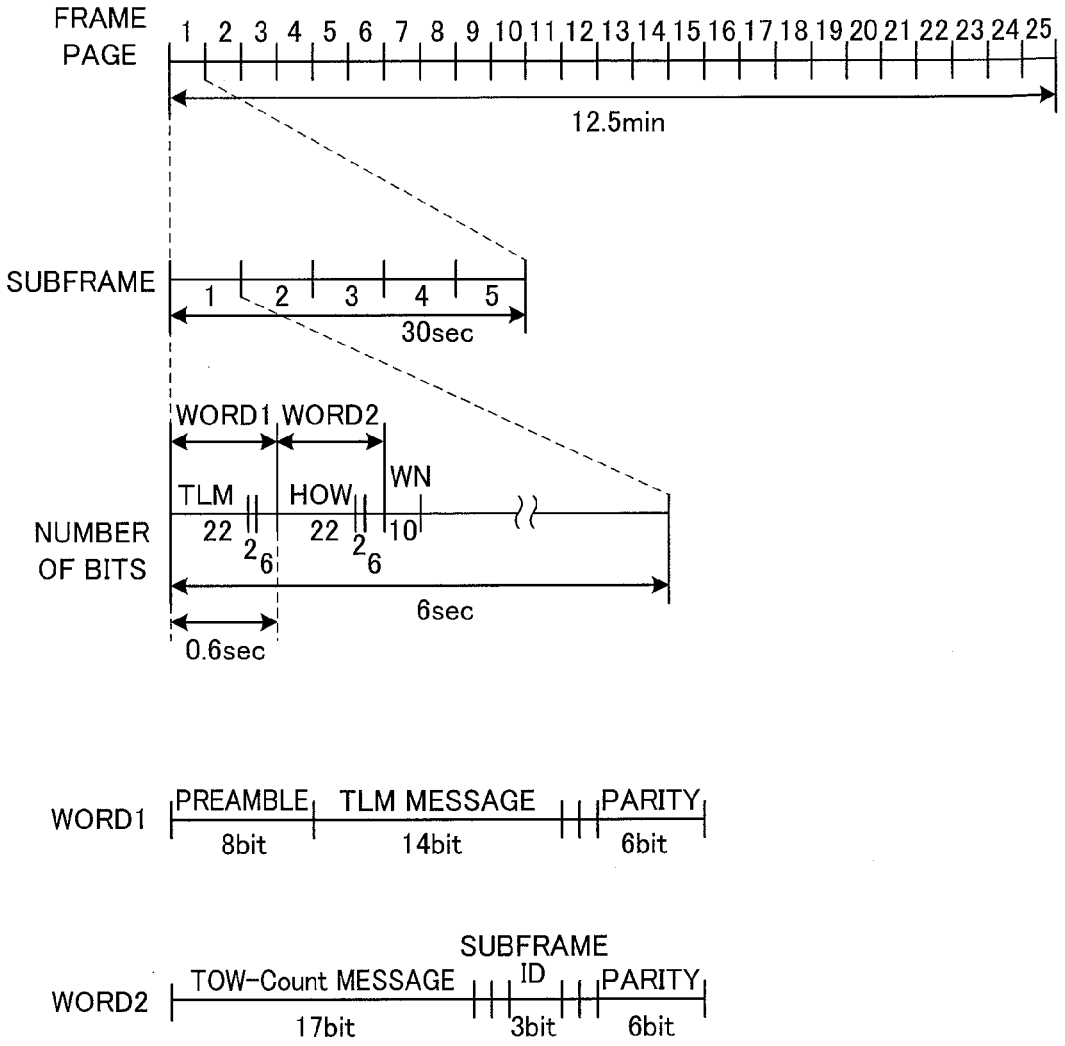
FIG. 2 is a view for explaining a format of transmitted radio wave from a GPS satellite.

FIG. 2 is a view for explaining a format of a transmitted radio wave from a GPS satellite.

Each of the GPS satellites performs phase modulation of navigation message data by a C/A code specific to each satellite and transmits the data at 50 bps, the navigation message data being data in which code data is arranged for a predetermined length. The navigation message data is transmitted in a unit of frame data (1500 bit) including five subframes of 300 bit length (6 seconds). The entire data of navigation message is formed of 25 frames (pages) and 12.5 minutes is required for receiving all of them.

Each of the subframes 1 to 3 includes date and time information indicating a date and time for the subframe, status information indicating a health condition of the GPS satellite, a condition of ionosphere and such like, and orbit information (ephemeris data) of the GPS satellite. As for the subframes 4 and 5, predicted orbit information (almanac data) regarding all the GPS satellites is divided into 25 frames and transmitted.

Each of the subframes is formed of 10 words (WORDs) of 30 bit length (0.6 seconds). Among the WORDs, the head WORD 1 includes TLM (telemetry word) of 22 bits, and the TLM starts by Preamble which is a code arrangement of fixed 8 bits. The WORD 2 includes HOW (Hand Over Word, first date and time information) of 22 bits. The HOW includes TOW-Count of 17 bits indicating an elapsed time (first time unit) in a week from 0 o'clock (lower limit) on Sunday as a starting point to 24 o'clock (upper limit) on Saturday as an endpoint. The value of TOW-Count (also called Z count) indicates an in-week elapsed time at the timing of the last end of the subframe including the TOW-Count, that is, at the transmission timing of head of the next subframe. At the head of WORD 3 in the subframe 1, WN (second date and time information) indicating a week number (second time unit) based on Jan. 6, 1980 as a reference is transmitted at 10 bits. At the end of each word, parity information of 6 bits is included to enable determination regarding whether the decoding of the word was accurately performed by checking the parity information.

Leap seconds are not considered, for the date and time transmitted from GPS satellites (GPS date and time), that is, the TOW-Count and WN values. The value of accumulated gap (offset value) of the GPS date and time from the UTC date and time generated by the leap seconds implemented after Jan. 6, 1980 is separately transmitted in the subframe 4 of page 18. Accordingly, the UTC date and time is obtained by subtracting the offset value from the obtained GPS date and time. The offset value according to the leap seconds is +16 seconds by 16 insertions of leap seconds as of Oct. 9, 2014.

Here, in a case where the date and time data held by the clocking circuit 46 is not assumed to have a gap of one week or more, the date and time of clocking circuit 46 is referred to, and thus, it is not necessary to obtain WN. As described above, the date and time error generated in the clocking circuit 46 is approximately 15 seconds per month, that is, approximately 0.5 seconds per day, and thus, a gap of one day or more is not generated even when the date and time is not corrected for a long period (for example, several years). Accordingly, the correct date and time can be normally identified merely by receiving and decoding HOW by combining the date counted by the clocking circuit 46 and the TOW-Count except for a case where a user manually changes the date and time to different one, a case where the battery is consumed to clear the counted value data in the clocking circuit 46 or a case where WN is obtained for confirmation in a state in which the date and time has not been corrected over a preset time period or more.

In this case, in the electronic timepiece 1, by the Preamble in any one of the subframes being detected, the position of data in the subframe is identified. Following this, the HOW data is obtained, and thereby, the date and time in the week is specified. That is, the time required for receiving Preamble and HOW is approximately 1 to 2 seconds for 2 to 3 words. Accordingly, in a case where the amount of gap of date and time data held in the clocking circuit 46 can be estimated, the HOW data is efficiently obtained by starting receiving a transmitted radio wave from GPS satellite at an appropriate timing to operate over around the above-mentioned time (reception period).

In a case where the date and time data is obtained by using only a transmitted radio wave from a single GPS satellite, the accurate distance between the GPS satellite and the receiving point cannot be obtained, and thus, it is not possible to accurately estimate the delay due to the transmission time of approximately 60 to 85 msec. Thus, the current date and time data may be obtained within a gap of approximately 15 msec by uniformly forwarding 70 msec from the obtained date and time, for example. Thus, it is possible to obtain nearly accurate date and time information within a range of small error that causes no practical issue of timepiece without extending the reception time, that is, without increasing the power consumption.

The special information such as information of offset value according to the above-mentioned leap seconds, data of cycle number of WN, implementation information of summer time used as needed and information according to time zone need to be separately held in advance. Here, these pieces of information are stored in the storage unit (nonvolatile memory of microcomputer) in the GPS reception processing unit 50 in advance. The pieces of information may also be set and updated manually by user's operation, and the information of offset value according to leap seconds may be obtained by receiving and decoding the transmitted radio waves (subframe 4 in page 18) from GPS satellites periodically (for example, twice a year).

Figure 3:
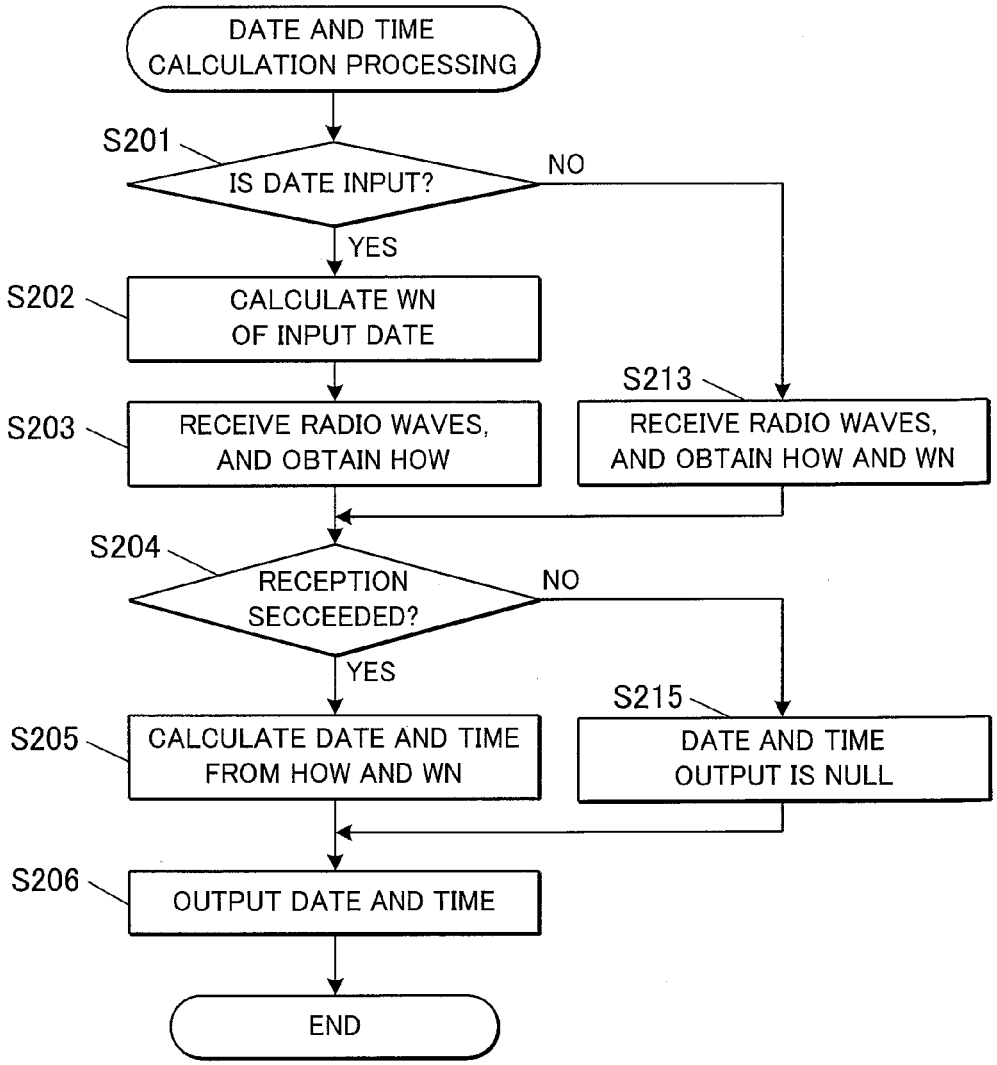
FIG. 3 is a flowchart showing a control procedure of date and time calculation processing to be executed by a control unit of a GPS reception processing unit in the first embodiment.

FIG. 3 is a flowchart showing a control procedure of date and time calculation processing executed by the control unit (CPU in microcomputer) of GPS reception processing unit 50 of the electronic timepiece 1 in the embodiment.

The date and time calculation processing starts when an instruction to obtain date and time information is input from the CPU 41.

The control unit determines whether the date is input from the CPU 41 together with the instruction (step S201). If it is determined that the date is input (step S201; YES), the control unit calculates the value (internal date and time information) of the week number (second time unit) corresponding to the WN by a back calculation from the date (step S202). Here, though not especially limited, the date in GPS date and time may be directly input, and the date in GPS date and time may be obtained by inputting the UTC date and time, referring to information according to the offset value of leap seconds stored in the storage unit and converting the UTC date and time into GPS date and time. Alternatively, in this date and time calculation processing, the date of UTC date and time may be directly obtained. The control unit calculates the WN from the obtained date. Then, the control unit starts receiving radio waves at an appropriate timing, tunes to the radio waves from GPS satellites, demodulates signals and obtains HOW on the basis of the detected Preamble position (step S203). The processing of control unit shifts to step S204.

If it is not determined that the date is input (step S201; NO), the control unit starts receiving radio waves, tunes to and demodulates the radio waves from GPS satellites and obtains HOW and WN on the basis of the detected Preamble position (step S213). Then, the processing of control unit shifts to step S204.

When shifting from the processing of step S203 or step S213 to the processing of step S204, the control unit determines whether the reception of date and time data succeeded (step S204). If it is determined that the reception succeeded (step S204; YES), the control unit calculates year, month, day and time from the obtained data of WN and HOW (step S205). The control unit simply combines the obtained WN and HOW, obtains GPS date and time corresponding to the cycle number of WN, and thereafter converts it into UTC date and time by referring to leap seconds correction data stored in the storage unit in the GPS reception processing unit 50. Ina case where the estimated life of electronic timepiece 1 is shorter than the cycle (approximately 19.6 years) of WN, the electronic timepiece 1 may have a configuration in which the week corresponding to the WN value can be directly identified without using the cycle number.

In the determination processing of step S204, if it is not determined that the reception of date and time data succeeded (step S204; NO), the control unit sets the date and time to NULL (no data) (step S215). Here, the day among the year, month and day (especially, the value of a day in a week, that is, a day of the week indicating the order of day unit) is the third time unit.

Following the processing of step S205 or step S215, the control unit outputs the calculated UTC date and time (step S206). Then, the control unit ends the date and time calculation processing.

Here, as described above, if the date and time counted by the clocking circuit 46 includes a small gap only, the date counted by the clocking circuit 46 is normally same as the date obtained from the received navigation message, and a gap of date is generated only when the navigation message is received around the turn of date, that is, around 0 o'clock. At this time, the TOW-Count indicates the elapsed time in a week starting at 0 o'clock on Sunday and ending at 24 o'clock on Saturday. Thus, the day of the week (order of day unit in a week) and time are accurately obtained even when there is a gap of date in the week, whereas, when crossing the turn of week, that is, the turn between Saturday and Sunday, the TOW-Count is sometimes changed to be a value of a different cycle, that is, a value of the previous week, or changed to a value of the next week even when the gap of date and time is small. As a result, the WN corresponding to the date and time counted by the clocking circuit 46 is combined with the TOW-Count having a largely changed value, and thereby the obtained date and time has a gap of approximately 7 days from the accurate date and time.

The case where the WN to which the date according to the date and time counted by the clocking circuit 46 belongs is different from the WN obtained from GPS satellites includes, in addition to the above case, a case where there is a time difference between the timing of obtaining WN and the timing of receiving HOW from the GPS satellites or timing of outputting the date and time on the basis of the received HOW.

The output timing of year, month, day and time calculated by using the obtained TOW-Count is possibly different from the head timing of next subframe according to the TOW-Count. For example, in a case where the WORD 2 of a subframe is received to obtain HOW and thereafter the year, month, day and time are output in synchronization with the second head timing (seconds synchronization point, approximately 1.8 seconds later) of each second, the date and time obtained from the WN and HOW, that is, the year, month, day and time which is 3 seconds earlier than the date and time at the head timing of the next subframe are calculated and output. On the other hand, in a case where HOW is obtained by WORD 2 to calculate the date and time, and thereafter the HOW of next subframe is further obtained and the matching between the TOW-Count according to the obtained HOW and the calculated date and time is confirmed and then the date and time is output by being synchronized to the first or second seconds synchronization point, the year, month, day and time which is 2 seconds or 3 seconds later than the date and time at the head timing of the next subframe which is obtained from the TOW-Count according to the first HOW are calculated and output.

Further, there is a case where the date, especially the week is changed due to the change of date and time for the offset value according to leap seconds when the date and time counted by the clocking circuit 46 is input in UTC date and time to be converted into the GPS date and time and when the calculated GPS date and time is converted into UTC date and time. At this time, when the week is changed only for one of the UTC date and time and GPS date and time in accordance with the input UTC date and time and the output timing of calculated GPS date and time, the WN of the same day of the week which is different for one week is obtained in some cases.

FIGS. 4A to 4D are diagrams showing patterns of cases where a large gap is generated between the input and output dates.

Hereinafter, the description is made by taking a case where the leap seconds offset is +16 seconds, and the date and time is output at the timing preceding by 3 seconds or less from the date and time corresponding to the obtained TOW-Count. Also, in FIGS. 4A to 4D, the input date WN and the output date WN are numbers indicating the cycles from 0 o'clock on Sunday to 24 o'clock on Saturday to which the input date (date of counted UTC date and time) and output date (date of output UTC date and time) belong respectively. For each of the calculated WN which is actually calculated from the counted GPS date and time, and the output GPS date and time, that is, the accurate WN which is a week number based on a WN which should be obtained when the GPS reception processing unit 50 obtains not only TOW-Count but also WN, the WN is a value to which 1 is added at 23:59:54 on Saturday so as to correspond to the transmission format from GPS satellite. Here, there is no gap of 1 day or more between the date and time counted by the clocking circuit 46 and the accurate date and time.

As shown in FIG. 4A, in a case where the UTC date and time (may include a gap) of clocking circuit 46 is the date and time on Saturday in the week number WN=n (n is any one of arbitrary integers represented by 10 bits) and the obtained TOW-Count value is the date and time on Sunday of the next week (WN=n+1) the WN=n and the TOW-Count are combined and the date and time a week before the accurate date and time is obtained. In this case, the difference between the date of input UTC date and time and date of output UTC date and time is 6 days.

On the other hand, as shown in FIG. 4B, in a case where the UTC date and time in the clocking circuit 46 is the date and time on Sunday in the week of week number WN=n, and the obtained TOW-Count value is the date and time on Saturday of previous week (WN=n−1), the WN=n and the TOW-Count are combined and the date and time one week after the accurate date and time is obtained. In this case, the date difference between the input UTC date and time and the output UTC date and time is 6 days.

As shown in FIG. 4C, in a case where the UTC date and time input from the clocking circuit 46 is before 23:59:38 on Saturday of the week number WN=n, the WN calculated from the GPS date and time (before timing of 23:59:54) based on the UTC date and time is the value (WN=n) of week including the Saturday. At this time, when the TOW-Count obtained by the GPS reception processing unit 50 is 0 to 3, the GPS date and time obtained by combining the WN with the TOW-Count is the value of Sunday in the week WN=n which is 1 week before the week number (WN=n+1) of next week which should be really obtained, and the GPS date and time at output timing is before 00:00:21 of Sunday (WN=n) after 23:59:57 on Saturday in the previous week (WN=n−1). Furthermore, in a case where the GPS date and time at the output timing is before 00:00:16 on Sunday, the output UTC date and time is after 23:59:41 before 24:00:00 on Saturday of week of week number WN=n−1, and as for the date of output UTC date and time, the date and time on Saturday of previous week is output by shifting −7 days from the date (Saturday of WN=n) of input UTC date and time.

As shown in FIG. 4D, in a case where the UTC date and time input from the clocking circuit 46 is within the same day after 23:59:38 on Saturday of week number WN=n (that is, before 24:00:00 on Saturday), the WN calculated from the GPS date and time based on the UTC date and time (Saturday) is the value (WN=n+1) of week of the next day that is Sunday. At this time, in a case where the TOW-Count obtained by the GPS reception processing unit 50 is 86403 or more, the GPS date and time obtained by combining WN with TOW-Count is the value of Sunday in the week (WN=n+1) one week after the real value, and the GPS date and time at the output timing is after 00:00:15 and before 23:59:54 on Saturday of next week (WN=n+1). Furthermore, in a case where the output GPS date and time is after 00:00:16 on Saturday, the output UTC date and time is after 00:00:00 and before 23:59:38 on Saturday of week number WN=n+1, and the date of output UTC date and time is shifted for +7 days from the date (Saturday of the week of WN=n) of input UTC date and time and the date and time on Saturday one week after the input date and time is output.

Figure 5:
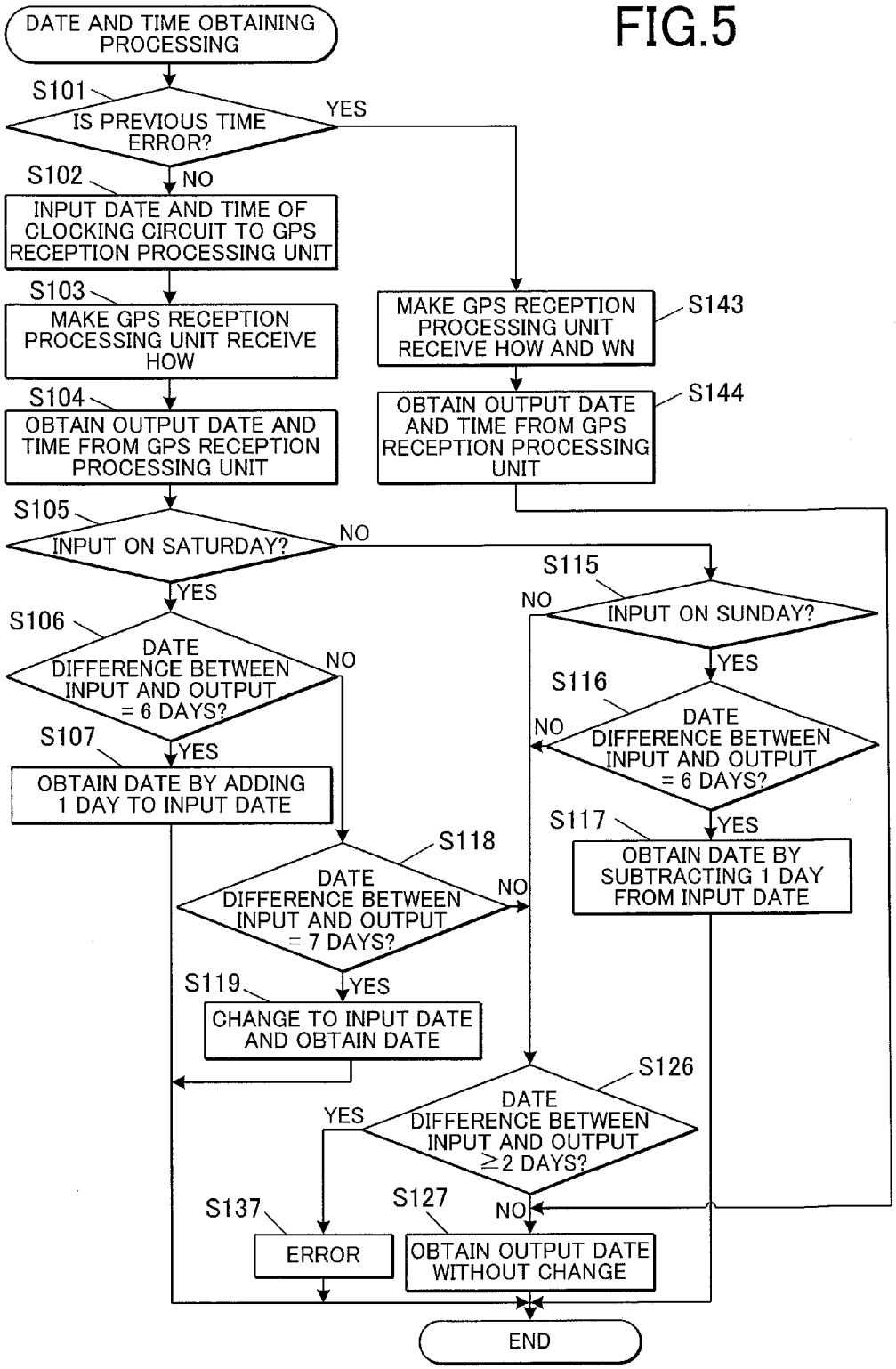
FIG. 5 is a flowchart showing a control procedure of date and time obtaining processing in the first embodiment.

FIG. 5 is a flowchart showing a control procedure of date and time obtaining processing executed by the CPU 41 in the electronic timepiece 1 in the embodiment.

When the date and time obtaining processing is started, the CPU 41 determines whether the output in the previous date and time obtaining processing was error (step S101). If it is determined that the output was error (step S101; YES), the CPU 41 makes the GPS reception processing unit 50 start receiving radio waves and calculate a date and time based on HOW and WN (step S143). The CPU 41 makes the GPS reception processing unit 50 output the calculated date and time and obtains the date and time (step S144). Then, the processing of CPU 41 shifts to step S127.

If it is not determined that the output was error (step S101; NO), the CPU 41 makes the GPS reception processing unit 50 start the above-mentioned date and time calculation processing and outputs the counted number of clocking circuit 46 and data of a date or a date and time to be held to the GPS reception processing unit 50 in UTC date and time (step S102).

Next, the CPU 41 makes the GPS reception processing unit 50 start receiving radio waves and calculate a date and time on the basis of the WN value in GPS clock calculated in the processing of step S202 by the date and time data of clocking circuit 46 output in the processing of step S102 and HOW received and obtained in the processing of step S203 (step S103). That is, the GPS reception processing unit 50 calculates a date and time by an in-week elapsed time specified by HOW in the week confirmed by the WN value in the processing of step S205. Then, the CPU 41 makes the GPS reception processing unit 50 output the calculated UTC date and time to obtain the date and time (step S104).

Further, the CPU 41 determines whether the date and time input to the GPS reception processing unit 50 in the processing of step S102 is Saturday (step S105). If it is determined that the input date and time is Saturday (step S105: YES), the CPU 41 determines whether the difference between the output date and the input date is 6 days (predetermined gap width) (step S106). If it is determined that the difference is 6 days (step S106: YES), the CPU 41 changes the date of output date and time to the date obtained by adding 1 day to the input date (that is, equivalent to the date obtained by subtracting 7 days corresponding to the unit width (unit width of second time unit) of WN from the output date) and obtains the value (step S107), and ends the date and time obtaining processing. If it is not determined that the difference is 6 days, (step S106: NO), the processing of CPU 41 shifts to step S118.

The CPU 41 determines whether the difference between the input and output dates is 7 days (step S118). If it is not determined that the date difference is 7 days (step S118: NO), the processing of CPU 41 shifts to step S126. If it is determined that the date difference is 7 days (step S118: YES), the CPU 41 changes the date of output date and time to the date of input date and time (that is, equivalent to the processing of adding or subtracting 7 days corresponding to the unit width of WN with respect to the date of output date and time) and obtains the date and time (step S119). Then, the CPU 41 ends the date and time obtaining processing.

If it is not determined that the date of input date and time is Saturday (step S105: NO), the CPU 41 determines whether the date of input date and time is Sunday (step S115). If it is determined that the date of input date and time is Sunday (step S115: YES), the CPU 41 determines whether the difference between output date and input date is 6 days (step S116). If it is determined that the difference is 6 days (step S116: YES), the CPU 41 changes the date of output date and time to the date obtained by subtracting 1 day from the input date (that is, equivalent to the date obtained by adding 7 days to the output date) to obtain the value (step S117), and ends the date and time obtaining processing. If it is not determined that the difference is 6 days (step S116: NO), the processing of CPU 41 shifts to step S126.

In any one of a case where it is not determined that the input date is Sunday (step S115: NO), a case where it is not determined that the date difference is 7 days in the determination processing of step S118, and a case where it is not determined that the date difference is 6 days in the processing of step S116, the CPU 41 determines whether the difference between the input date and output date is 2 days or more (larger than 1 day (predetermined width)) (step S126). If it is not determined that the difference is 2 days or more (step S126: NO), the CPU 41 obtains the output date without change (step S127), and ends the date and time obtaining processing. If it is determined that the difference is 2 days or more (step S126: YES), the CPU 41 sets the date output as error (step S137), and ends the date and time obtaining processing.

In an analog type electronic timepiece operating hands by compact motor (stepping motor), in some cases, the normal rotation of motor becomes out of order when influenced by a magnetized device, the positions indicated by hands are delayed or moved forward, and the hands stop depending on circumstances. Thus, even if it is determined that the difference is 2 days or more (step S126: YES), the CPU 41 may obtain the output date without change (shift to step S127).

When the date and time is obtained by any one of the processing of steps S107, S117, S119 and S127, the CPU 41 corrects the date and time of clocking circuit 46 on the basis of the obtained date and time and stores the history of the obtaining in the correction history storage unit 43*a* together with the obtained date and time.

FIG. 6 is a diagram showing processing contents of date and time obtaining processing with respect to a day of the week of clocking circuit 46 input to the GPS reception processing unit 50 and a day of the week output from the GPS reception processing unit 50.

As shown in FIG. 6, when the date and time of Sunday is input to the GPS reception processing unit 50 and the date and time of Saturday is output, in the date and time obtaining processing, the date and time is obtained by subtracting 7 days from the output date of Saturday. For example, in a case where 00:01 on Sep. 15, 2013 in UTC date and time is input to the GPS reception processing unit 50 and the correct UTC date and time is 23:58 on Sep. 14, 2013, the date output from the GPS reception processing unit 50 is 23:58 on Sep. 21, 2013 that is in the week of September 15, and thus, 7 days are subtracted from the date 21 and the date is changed to September 14.

On the other hand, in a case where the date and time of Saturday is input to the GPS reception processing unit 50 and the date and time of Sunday is output, in the date and time obtaining processing, the date and time is obtained by adding 7 days to the output date of Sunday. For example, in a case where 23:58 on Sep. 14, 2013 is input to the GPS reception processing unit 50 and the correct time is 00:01 on Sep. 15, 2013, the date output from the GPS reception processing unit 50 is 00:01 on September 8 which is in the week of September 14, and thus, 7 days are added to the date and the date and time is changed to 00:01 on September 15.

There is a case where the date and time of Saturday which has a gap of 7 days is output as described above in addition to a case where the date and time of Saturday is input and the date and time of Saturday is output (corresponding to the position of mark "*" in FIG. 6A) and a case where the same date as the input date is output. In such case, in the date and time obtaining processing of the embodiment, the date is changed to the date obtained by adding or subtracting 7 days, that is, to the original input date. For example, in a case where 23:59:00 on Sep. 14, 2013 is input to the GPS reception processing unit 50 and the correct UTC date and time is 23:59:50 on Sep. 14, 2013, the date output from the GPS reception processing unit 50 is 23:59:50 on September 7, and thus, the input date is used instead of the output date (or 7 days are added to the output date), and the date is changed to 23:59:50 on September 14.

In a case where a date and time from Monday to Friday is input to the GPS reception processing unit 50 and the same day of the week or a day of the week before/after the day of the week, the date of the day of the week is obtained without change as the correct date and time. Also in a case where the date and time of Sunday is input and the date and time of Sunday or Monday is output and in a case where the date and time of Saturday is input and the date and time of Friday or Saturday is output, the date of the day of the week is treated as correct.

In the electronic timepiece 1 of the embodiment, in a case where the date gap is 2 days or more and less than 6 days, the output date and time is not obtained as an output error. For example, when 00:01 of September 14 is input and 23:58 of September 12 is output, the date gap is 2 days and thus, the output date and time is not obtained.

As described above, the electronic timepiece 1 of the embodiment includes a clocking circuit 46 which counts date and time, a GPS reception processing unit 50 which receives transmitted radio waves from GPS satellites and an antenna 51. The microcomputer of GPS reception processing unit 50 controls the radio wave reception period from the GPS satellites and the CPU 41 obtains the date and time from the received transmitted radio waves.

The microcomputer of GPS reception processing unit 50 receives only in-week elapsed time information among the in-week elapsed time information (HOW) in a unit of seconds transmitted from the GPS satellites and week number information (WN) in a week unit with the GPS reception processing unit 50, and calculates a date and time within a range according to the specified week number information on the basis of the week number information calculated from the date and time counted by the clocking circuit 46 and the in-week elapsed time information received by the GPS reception processing unit 50. The date and time of clocking circuit 46 is corrected on the basis of the difference between the date and time calculated by the GPS reception processing unit 50 and the date and time counted by the clocking circuit 46.

Thus, since the reception operation for obtaining the week number information can be omitted, the reception period of radio waves from the GPS satellites is shortened and the increase in power consumption can be suppressed while time less than a week and synchronization timing thereof are obtained. Thus, it is possible to receive information necessary for obtaining a correct date and time efficiently.

Also, it is determined whether the date and time calculated by the GPS reception processing unit 50 is different from the date and time counted by the clocking circuit 46 for a predetermined width (here, 6 days) or more, the predetermined width being determined on the basis of the clocking error of the clocking circuit 46 in a week, and if it is determined that the date and time calculated by the GPS reception processing unit 50 is different for the predetermined width or more, the calculated date and time is shifted for a week in the direction opposite to the direction in which the date and time calculated by the GPS reception processing unit 50 is different from the date and time counted by the clocking circuit 46.

Accordingly, in a case where there is a weekend between the date and time counted by the clocking circuit 46 and the date and time received from the GPS satellite and output from the GPS reception processing unit 50 due to the counting error of the clocking circuit 46, it is possible to obtain an accurate date and time with easy processing by determining a large gap which is not predicted as a counting error and shifting the output date and time for a week.

Especially, by receiving HOW transmitted from the GPS satellites, it is possible to obtain in-week elapsed time by short intervals, that is, in a short reception period for each of the subframes even when the time of clocking circuit 46 has a gap.

Especially, in a case where the date calculated on the basis of date and time counted by the clocking circuit 46 and HOW received from the GPS satellite is Sunday or Saturday, by determining whether the difference between the calculated date and the date counted by the clocking circuit 46 is 6 days or more, the CPU 41 identifies the gap direction more easily, and can easily recognize that the date and time counted by the clocking circuit 46 really has a gap and that the date and time is decoded wrongly from HOW data, and thus, it is possible to obtain the accurate date by easier and more reliable processing.

Especially, since wrong decoding of week number is recognized by the date difference, the determination processing according to the wrong decoding can be easily performed.

It is also possible to recognize wrong decoding of week number by appropriately reflecting the difference between the GPS date and time and UTC date and time not considering leap seconds without complicated processing.

In a case where the difference between the calculated date and the date counted by the clocking circuit 46 is within a range of 2 days or more and less than 6 days, the calculated date is not obtained to be used as the current date and time. Accordingly, in a case where there is a gap larger than the clocking error which is normally predicted, such as a case where the user manually shifts the date and a case where the date is largely shifted due to the operation error or the like of electronic timepiece 1, for example, it is possible to leave it up to user's determination to maintain the current state, to receive WN from GPS satellites and such like without turning back the intentional shift in a halfway manner or setting the date to an incorrect date and time.

Also in this case, the microcomputer of GPS reception processing unit 50 can turn back the date and time to correct date and time display promptly by performing the receiving operation of radio waves from GPS satellites again, receiving both of HOW and WN, and thereby obtaining the accurate date and time.

BY applying the present invention to the electronic timepiece 1 which includes the display unit 48 and controls the operation of display unit 48 with the CPU 41 to enable the display of date and time, it is possible to display accurate date and time information on the display unit 48 stably and continuously for a long period and make the user acquire accurate date and time while suppressing the power consumption.

It is possible to widely achieve both reduction in power consumption and acquisition of accurate date and time information at the same time in an electronic device by installing a program stored in a computer readable recording medium according to the present invention to the electronic device having the clocking circuit 46, GPS reception processing unit 50 and antenna 51.

[Second Embodiment]

Next, a second embodiment of an electronic device of the present invention will be described.

Figure 7:
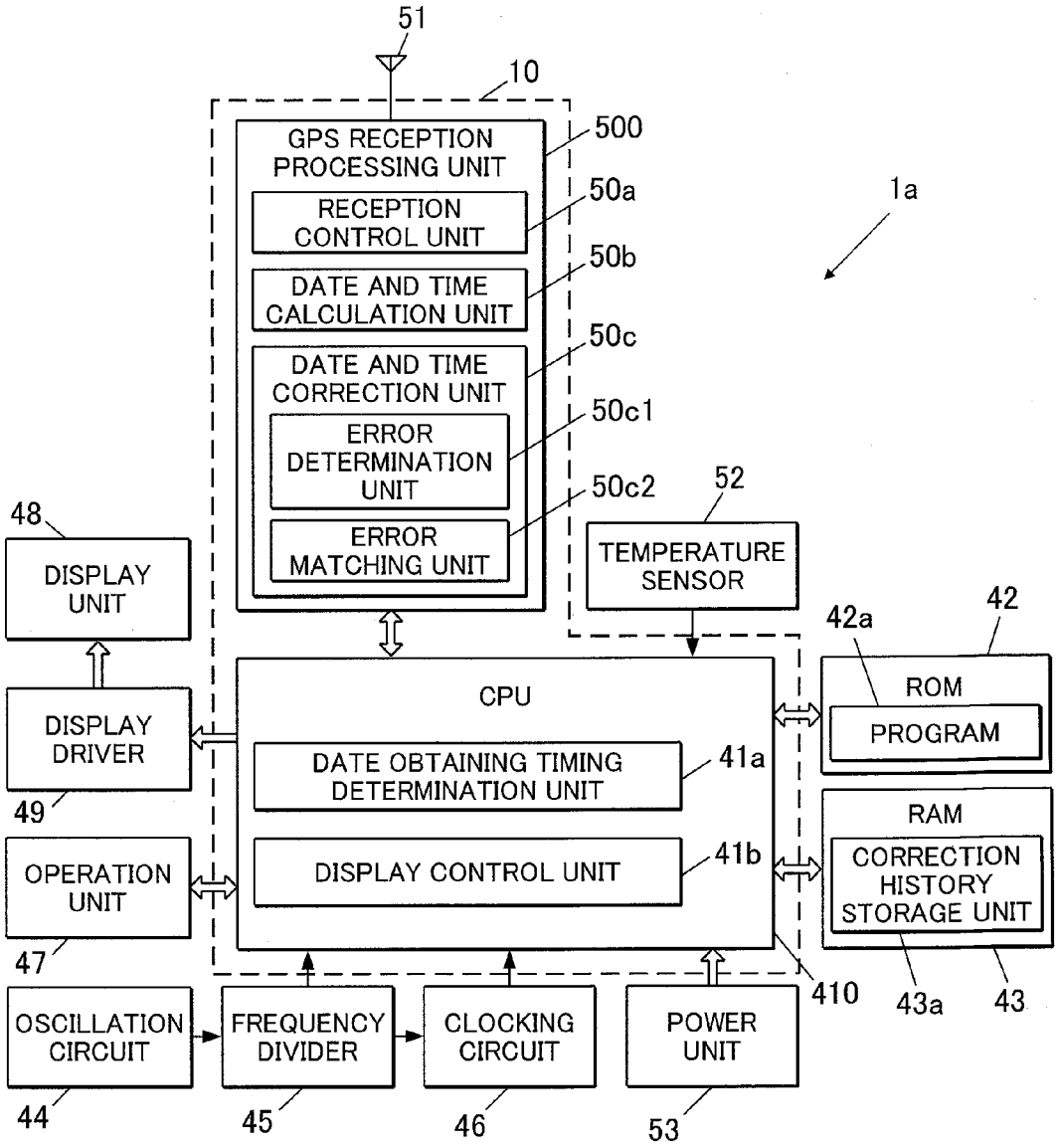
FIG. 7 is a block diagram showing an internal configuration of an electronic timepiece in a second embodiment.

FIG. 7 is a block diagram showing an internal configuration of an electronic timepiece 1*a* which is the second embodiment of the electronic device of the present invention.

The internal configuration of electronic timepiece 1*a* is the same as that of the electronic timepiece 1 of the first embodiment except that the GPS reception processing unit 500 includes a date and time correction unit 50*c* (error determination unit 50*c*1 and error matching unit 50*c*2) and the CPU 410 does not include the date and time correction unit 41*c* (error determination unit 41*c*1 and error matching unit 41*c*2) of the CPU 41. Thus, the explanation thereof is omitted by using same reference numerals for the respective same components.

The date and time obtaining operation in the electronic timepiece 1*a* in the embodiment will be described.

In the electronic timepiece 1 of the first embodiment, the GPS reception processing unit 50 performs processing in GPS date and time, UTC date and time is used for input and output between the CPU 41 and GPS reception processing unit 50, and the CPU 41 corrects the date and time by using the UTC date and time. However, in the electronic timepiece 1*a* of the second embodiment, the date and time correction processing is performed by the GPS reception processing unit 500 as the date and time correction unit 50*c* on the basis of GPS date and time, and the CPU 410 obtains the date and time output from the GPS reception processing unit 500 without change. Accordingly, in the date and time obtaining processing in the electronic timepiece 1*a* of the embodiment, the date of GPS date and time corresponding to UTC date and time counted by the clocking circuit 46 and the date of the obtained GPS date and time are limited to a date within the same week and the date difference between input and output is not 7 days.

FIG. 8 is a diagram showing processing contents of date and time obtaining processing in the embodiment with respect to a day of the week of clocking circuit 46 input to the GPS reception processing unit 500 and a day of the week output from the GPS reception processing unit 500.

That is, as shown in FIG. 8, when the date and time of Saturday is input and the date and time of Saturday is output, the date and time of the day is surely output.

Furthermore, as WN and TOW-Count calculated from the input date and time, the value at the head timing of the subframe including the input date and time (that is, value delayed for one count in TOW-Count compared to the WN and TOW-Count of the first embodiment) is calculated, and thereby, the reset of TOW-Count and increase in WN can be performed at 00:00:00 on Sunday. Following this, the WN and TOW-Count obtained from GPS satellites are used by subtracting one count in TOW-Count. The GPS date and time at the output timing from the GPS reception processing unit 500 is obtained by adding the elapsed time (for example, 3 or 8 seconds) from the head to the output timing of the subframe to the date and time obtained by the WN and TOW-Count. The UTC date and time at the output timing is obtained by further subtracting the leap seconds offset value (+16 seconds) from the GPS date and time.

Figure 9:
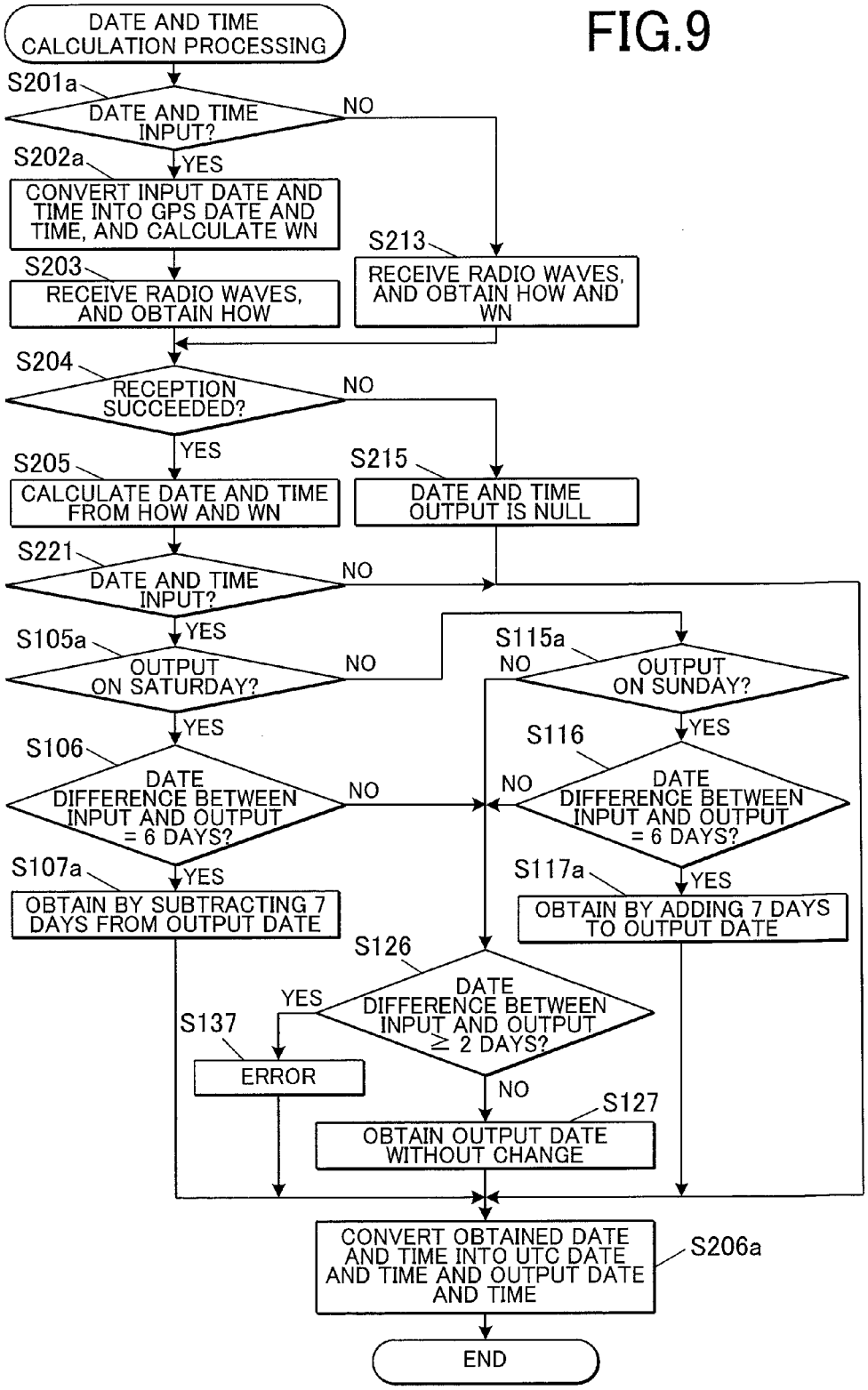
FIG. 9 is a flowchart showing a control procedure of date and time calculation processing in the second embodiment.

FIG. 9 is a flowchart showing a control procedure by the control unit in the GPS reception processing unit 500 of the date and time calculation processing executed in the electronic timepiece 1*a* in the embodiment.

In the date and time calculation processing, a part of the date and time obtaining processing which is executed by the CPU 41 in the electronic timepiece 1 in the first embodiment is combined with a part of the date and time calculation processing which is executed by the control unit of the GPS reception processing unit 50. Specifically, in the date and time calculation processing in the electronic timepiece 1*a* in the embodiment, the processing of steps S201, S202 and S206 of the date and time calculation processing in the electronic timepiece in the first embodiment is replaced with the processing of steps S201*a*, S202*a* and S206*a*, respectively, and the processing of steps S203 to S205, S213 and S215 is used without change. Also, in the date and time obtaining processing in the electronic timepiece 1 of the first embodiment, the processing of steps S105, S107, S115 and S117 is replaced with the processing of steps S105*a*, S107*a*, S115*a* and S117*a*, respectively, and the processing of steps S106, S116, S126, S127 and S137 is used without change. Furthermore, processing of step S221 is newly added.

As for the same processing as the processing of the first embodiment, detailed description thereof is omitted by providing same reference numerals.

In the date and time calculation processing in the embodiment, the control unit determines whether the date and time is input from the CPU 410 (step S201*a*). If it is determined that the date and time is input (step S201*a*), the control unit converts the date and time (UTC date and time) into the GPS date and time, and then, calculates WN (step S202*a*). The control unit obtains HOW from the received data from the GPS satellite and identifies the TOW-Count (step S203).

If it is not determined that the date and time is input (step S202*a*: NO), the control unit obtains WN and HOW (TOW-Count) from the received data from GPS satellite (step S213).

When the date and time is calculated in the processing of step S205, the control unit determines whether it was determined that the date and time was input from the CPU 410 in the determination processing of step S201*a* (step S221). If it is determined that it was not determined that the date and time was input (step S221: NO), the processing of the control unit shifts to step S206*a*. If it is determined that it was determined that the date and time was input, the processing of the control unit shifts to step S105*a*.

The control unit determines whether the date of output date and time is Saturday (step S105*a*). If it is determined that the date is Saturday (step S105*a*: YES), the processing of the control unit shifts to step S106. If it is not determined that the date is Saturday (step S105*a*: NO), the control unit determines whether the date of output date and time is Sunday (step S115*a*). If it is determined that the date is Sunday (step S115*a*: YES), the processing of the control unit shifts to step S116. If is it not determined that the date is Sunday (step S115*a*: NO), the processing of the control unit shifts to step S126.

In the determination processing of step S106, if it is determined that the date difference between input and output is 6 days (step S106: YES), the control unit obtains the date and time by subtracting 7 days from the date of output date and time (step S107*a*). Then, the processing of the control unit shifts to step S206*a*.

In the determination processing of step S106, if it is not determined that the date difference between input and output is 6 days (step S106: NO), the processing of the control unit shifts to step S126.

In the determination processing of step S116, if it is determined that the date difference between input and output is 6 days (step S116: YES), the control unit obtains the date and time by adding 7 days to the date of output date and time (step S117*a*). Then, the processing of the control unit shifts to step S206*a*.

When the processing of steps S127, S137 and S215 ends, the processing of the control unit shifts to step S206*a*.

When shifting from the processing of each of steps S107*a*, S117*a*, 5127, 5137, 5215 and S221 to the processing of step S206*a*, the control unit converts the obtained date and time into UTC date and time and outputs the date and time to the CPU 410 (step S206*a*). Then, the control unit ends the date and time calculation processing.

Figure 10:
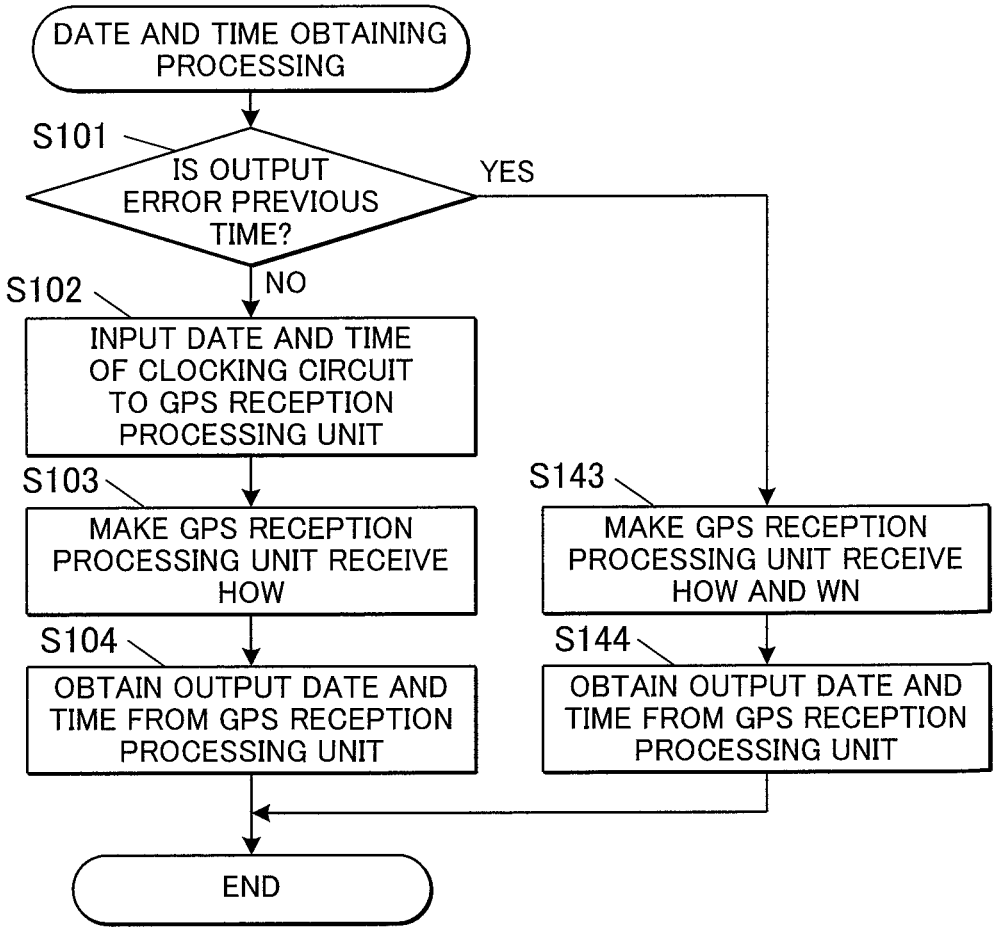
FIG. 10 is a flowchart showing a control procedure of date and time obtaining processing in the second embodiment.

FIG. 10 is a flowchart showing a control procedure by the CPU 410 in the date and time obtaining processing executed in the electronic timepiece 1*a* in the embodiment.

As described above, since the processing corresponding to each processing after step S105 according to correction of date is executed in the GPS reception processing unit 500 in the electronic timepiece 1*a* in the embodiment, all of these processing is omitted in the date and time obtaining processing. The CPU 410 obtains, without change, the UTC date and time output from the GPS reception processing unit 500 in the processing of steps S104 and S144 and ends the processing. The contents of processing to be executed is the same as the contents of processing executed by the electronic timepiece 1 in the first embodiment, and the explanation thereof is omitted.

As described above, in the electronic timepiece 1*a* of the second embodiment, in the date and time calculation processing executed by the CPU (control unit) of a microcomputer of the GPS reception processing unit 500, the control unit calculates WN from the GPS date and time converted from the input UTC date and time, and combines the WN with the obtained TOW to obtain the date and time. Meanwhile, the control unit responds to a gap between the GPS date and time converted from the input UTC date and time and the obtained GPS date and time and performs processing for detecting and correcting a gap of 6 days generated in a case of crossing the weekend. Thus, the GPS reception processing unit 500 can output a date and time accurately responding to the weekend crossing. Accordingly, it is possible to obtain an accurate date and time with easy processing.

Since the comparison of date and time between input and output is performed at the level of GPS date and time, a gap of 7 days is not generated, and thus, it is possible to determine and correct a date gap easily by responding to a gap within a week.

Since the correction processing of the date of output date and time is directly performed with respect to the output date and the correction amount is limited to the length of one cycle of TOW-Count, the processing can be performed easily with uniformed processing by omitting processing such as combining a part (time) of output date and time with a part (date) of input date and time.

[Modification Example]

Next, a modification example of operation according to date and time obtaining will be described.

In the date and time obtaining operation of the modification example, date is corrected only when the difference between input and output date and time is within 15 seconds, and when the difference is larger than 15 seconds, the date and time is treated as error and not corrected.

Figure 11:
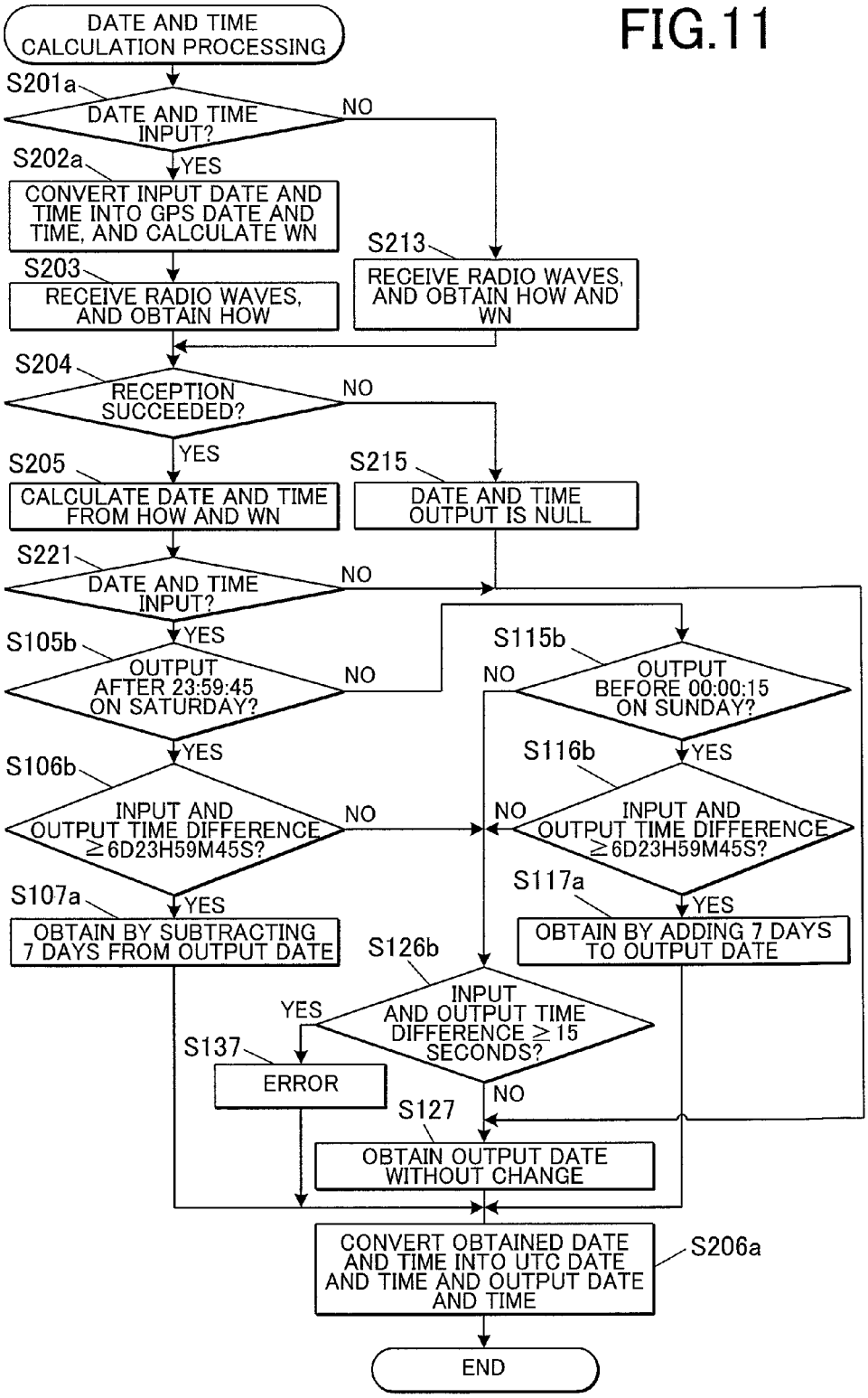
FIG. 11 is a flowchart showing a modification example of date and time calculation processing.

FIG. 11 is a flowchart showing a modification example of a control procedure by the control unit of GPS reception processing unit 500 of date and time calculation processing executed in the electronic timepiece 1*a* in the second embodiment.

Here, as in the above-described second embodiment, the description is made for a case of calculating WN which increases by 1 at 00:00:00 on Sunday according to the date and time at the head timing of current subframe, and combining it with the value obtained by subtracting 1 from the obtained TOW-Count to calculate the date and time. Also in the description, in order to accurately determine the above difference of 15 seconds, the input date and time in the modification example described here is the date and time obtained by considering the elapsed time from when the UTC date and time is input from the CPU 410 to the GPS reception processing unit 500 until the timing when the calculated output date and time is output to the CPU 410.

The date and time calculation processing in the modification example is the same as the date and time calculation processing in the second embodiment except that the processing in steps S105, S106, S115, S116, S126 and S137 of the date and time calculation processing in the second embodiment is replaced with steps S105*b*, S106*b*, S115*b*, S116*b*, S126*b* and S137*b*, respectively. The detailed description thereof is omitted by providing same reference numerals to the same processing.

In the determination processing of step S221, if it is determined that UTC date and time was determined to be input from the CPU 410 in the determination processing of step S201*a* (step S221: YES), the control unit determines whether the calculated GPS date and time (in-week elapsed time) at the output timing is after 23:59:45 on Saturday ($7^{th}$ day) (step S105*b*). If it is determined that the GPS date and time is after 23:59:45 on Saturday (step S105*b*: YES), the control unit determines whether the time difference between the GPS date and time to be output and the current GPS date and time which is converted from the UTC date and time input to the GPS reception processing unit 500 and counted is 6 days, 23 hours, 59 minutes and 45 seconds or more (step S106*b*). If it is determined that the time difference is 6 days, 23 hours, 59 minutes and 45 seconds or more (step S106*b*: YES), the processing of the control unit shifts to step S107*a*. If it is not determined that the time difference is 6 days, 23 hours, 59 minutes and 45 seconds or more (step S106*b*: NO), the processing of control unit shifts to step S126*b*.

The control unit determines whether the time difference between output date and time and input date and time in GPS date and time is 15 seconds or more (step S126*b*). If it is determined that the time difference is 15 seconds or more (step S126*b*: YES), the processing of the control unit shifts to step S137*b*, and the control unit performs error output and deletes the last date and time correction history.

On the other hand, if it is not determined that the time difference is 15 seconds or more (step S126*b*: NO), the processing of control unit shifts to step S127.

In the processing of step S105*b*, if it is not determined that the in-week elapsed time at the GPS date and time according to output date and time is after 23:59:45 on Saturday ($7^{th}$ day) (step S105*b*: NO), the control unit determines whether the in-week elapsed time of output date and time at the GPS date and time is before 00:00:15 on Sunday (first day) (step S115*b*). If it is determined that the in-week elapsed time of output date and time at the GPS date and time is before 00:00:15 on Sunday (first day) (step S115*b*: YES), the control unit determines whether the time difference between the output date and time and input date and time is 6 days, 23 hours, 59 minutes and 45 seconds or more (step S116*b*). If it is determined that the time difference is 6 days, 23 hours, 59 minutes and 45 seconds or more (step S116*b*: YES), the processing of the control unit shifts to step S117*a*. If it is not determined that the time difference is 6 days, 23 hours, 59 minutes and 45 seconds or more (step S116*b*: NO), the processing of control unit shifts to step S126*b*.

In the processing of step S115*b*, if it is not determined that the in-week elapsed time according to the output date and time at GPS date and time is before 0 hour 0 minute and 15 seconds on Sunday (first day) (step S115*b*: NO), the processing of control unit shifts to step S126*b*.

Among the above processing, the pattern of proceeding to "YES" in each of steps S105*b* and S106*b* corresponds to FIG. 4D, and the pattern of proceeding to "YES" in each of steps S115*b* and S116*b* corresponds to FIG. 4C. In a case of FIG. 4A and FIG. 4B, since the difference between the date and time counted by the clocking circuit 46 and the output date and time (accurate date and time) is larger than 15 seconds, the obtaining is not succeeded by the operation according to the date and time obtaining in the modification example.

Figure 12:
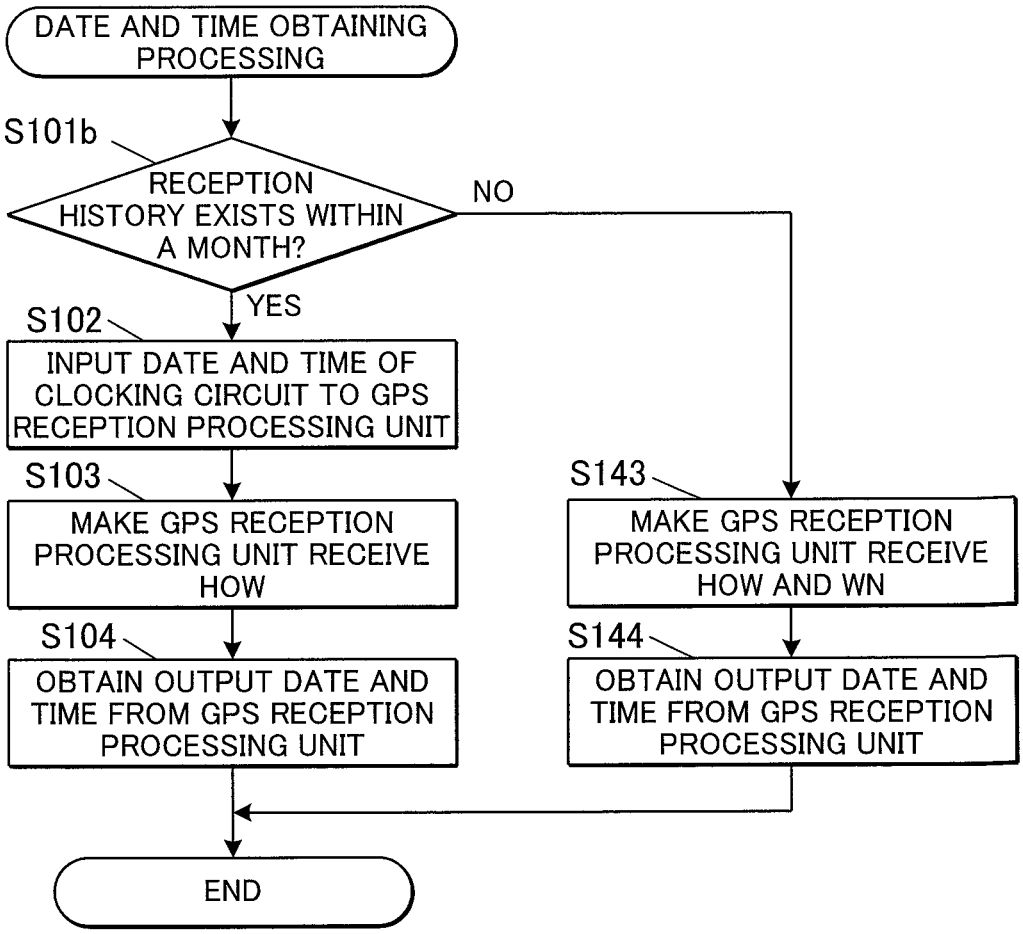
FIG. 12 is a flowchart showing a modification example of date and time obtaining processing.

FIG. 12 is a flowchart showing a control procedure by the CPU 410 of date and time obtaining processing in the modification example.

The date and time obtaining processing is same as date and time obtaining processing in the second embodiment except that the processing of step S101 in date and time obtaining processing executed by the electronic timepiece 1*a* in the second embodiment is replaced with the processing of step S101*b*, and the explanation thereof is omitted by providing same reference numerals to the same processing contents.

In the date and time obtaining processing, the CPU 410 determines whether there is a reception history within a last one month by referring to the correction history storage unit 43*a* (step S101*b*). The period of 1 month corresponds to the period that a gap generated for the date and time counted by the clocking circuit 46 becomes approximately 15 seconds as described above. If it is determined that there is a reception history within a month (step S101*b*: YES), the processing of CPU 410 shifts to step S102. If it is not determined that there is a reception history within a month (step S101*b*: NO), the processing of CPU 410 shifts to step S143.

As described above, in the modification example of date and time obtaining processing, it is determined whether the elapsed time from the previous date and time obtaining is a predetermined period (here, 1 month, for example) or more, the predetermined period being determined on the basis of a clocking error of the clocking circuit 46. If it is determined that the elapsed time is the predetermined period or more, the microcomputer of the GPS reception processing unit 500 makes the GPS reception processing unit 500 receive both HOW and WN, and the CPU 410 calculates a date and time as usual by HOW and WN received by the GPS reception processing unit 500. Accordingly, in a case where a large gap is predicted for the date and time of clocking circuit 46, it is possible to obtain the accurate date and time data efficiently without straining to perform adjustment with only HOW nor without complicating the processing by receiving WN from first.

In the RAM 43, the correction history storage unit 43*a* is provided to store the date and time of last correction of date and time data, and the elapsed time from the previous obtaining of date and time is calculated on the basis of the date and time data to perform comparison with the predetermined period. Thus, it is not necessary to provide a dedicated counter or the like, and it is possible to determine whether to obtain WN data by calculating the elapsed time easily when necessary.

When the calculated date and time (in-week elapsed time) is within 15 seconds set as a predetermined gap width from its lower limit, here, 0 seconds, that is, 00:00:00 on Sunday or its upper limit, here, the 24:00:00 on Saturday corresponding to 7 days, the CPU 410 sets the 6 days 23 hours 59 minutes and 45 seconds obtained by subtracting 15 seconds from 7 days as a predetermined width, and determines whether the week crossing is generated due to the clocking error by whether the difference between input and output times is larger than the predetermined width. That is, since the range of date and time which could be output due to the clocking error is set by the predetermined width with respect to input date and time, it is possible to obtain an accurate date and time by determining clocking error more surely.

When the calculation of date and time is error, by deleting the history in the processing of step S137*b*, it is determined in the processing of step S101*b* in the next date and time obtaining processing that there is no reception history within a month, and it becomes easier to proceed to the processing of step S143.

The present invention is not limited to the above embodiments and various changes can be made.

For example, in the above embodiments, determination is made by assuming that the date to be output is within the range of input date ±1 day; however, the present invention is not limited to this. For example, when the output date exceeds the input date for more than 4 days, the date and time obtained by subtracting 7 days from the output date and time is obtained, and when the output date is delayed from the input date for more than 4 days, the date and time may be obtained by adding 7 days to the output date and time.

Though the above embodiments have been described by citing, as an example, a gap in date and a gap in seconds, the gap may be in other unit levels. That is, a gap in hour and minute when the output date and time was input is set to be the target, and it is possible to correct a date according to a gap within approximately 2 minutes by moving the date for 7 days when there is a gap of 6 days 23 hours and 58 minutes or more, for example, and it is possible to assume the date and time as error or the output date and time as correct when there is a gap, which is smaller than the gap, between the output date and time and the input date and time. Such dividing way can be determined on the basis of the clocking error (rate) of clocking circuit 46 similarly to the modification example.

In the above embodiments, the processing is performed after conversion into year month day of the week and hour minute seconds on the basis of HOW and WN; however, the conversion into year month day of the week and hour minute seconds may be performed after performing the processing with the seconds value based on a predetermined reference in the electronic timepiece 1.

In the above embodiments, last correction date and time was stored in the correction history storage unit 43*a*; however, the elapsed time may be counted by operating a counter by setting the correction date and time as a starting point instead of such storing. In this case, it is possible to stop the counting to be reset at the point when the counting was performed for a predetermined period of time.

The above embodiments have been described by citing, as an example, a case where the GPS reception processing unit 50 and the CPU 41 (GPS reception processing unit 500 and CPU 410) form the date and time obtaining unit 10, the GPS reception processing unit 50 calculates a date and time as the date and time calculation unit 50*b* by HOW received by the GPS reception processing unit 50 and the date and time of clocking circuit 46 obtained from the CPU 41, and the CPU 41 which obtained the calculated time performs adjustment on the basis of the size of gap as the date and time correction unit 41*c* (error determination unit 41*c*1 and error matching unit 41*c*2) in a case of weekend crossing, and a case where the GPS reception processing unit 500 as the date and time calculation unit 50*b* and date and time correction unit 50*c* (error determination unit 50*c*1 and error matching unit 50*c*2) performs adjustment in a case of weekend crossing. However, the CPU 41 may calculate and correct a date and time as the date and time calculation unit and date and time correction unit 41*c* while the GPS reception processing unit 50 outputs a value based on HOW, and the processing for obtaining correct time can be performed by appropriately assigning the processing to CPUs (microcomputers) inside the electronic timepiece 1 or performed integrally by a single CPU.

The condition for limiting the error within 15 seconds which is shown in the modification example of second embodiment may be applied to the date and time obtaining processing shown in the first embodiment. In this case, individual conditions are used as shown in FIGS. 4C and 4D according to the offset value (+16 seconds at present) according to leap seconds and a gap (6 seconds) between the reset timing of TOW-Count and date change timing.

On the other hand, the cases (7 days gap) shown in FIGS. 4C and 4D cannot be generated only in a specific period and condition, and thus, it may be neglected without addition to the date and time obtaining processing and date and time calculation processing. In this case, limitations may be provided so as not to perform calculation and obtaining of date and time in the period.

Even in a case where the determination of case is performed, the date difference of input and output may be treated as 6 days or more including the case of 6 days to perform addition/subtraction of 7 days to the output date.

The above embodiments have been described for a case where date and time information is input and output in UTC date and time between the CPU 41 and GPS reception processing unit 50, and the GPS reception processing unit 50 performs processing in GPS date and time; however, the date and time to be input and output may be specific local time and such like other than UTC date and time. However, the date and time of local time at the timing of crossing the weekend in GPS date and time is shifted from weekend (24:00:00 on Saturday) due to the difference between GPS date and time and local time increasing to be larger than the difference between the GPS date and time and UTC date and time. Thus, in a case of determining a gap of 1 week according to the present invention by local time, it is necessary to set a determination condition according to the local time in some cases.

The above embodiments have been described by citing, as an example, data of GPS satellites outputting TOW-Count which is time in a week; however, the present invention can be similarly applied to other format satellites so as to correspond to the format.

For example, as for data of GLONASS satellites, time corresponding to a string number is obtained for each string, and date data is obtained once for each frame. Accordingly, the following processing can be performed for the times of both ends. For example, when a time between 23 o'clock and 24 o'clock is input and a time between 0 o'clock and 1 o'clock is output, the date is moved forward for 1 day. When a time between 0 o'clock and 1 o'clock is input and a time between 23 o'clock and 24 o'clock is output, the date is delayed for 1 day.

In a case of error in the date and time obtaining processing, only the time may be corrected without changing the date, or the processing may be directly ended. Alternatively, the correct date and time may be obtained by deleting reception history within a week and thereafter executing date and time obtaining processing again to receive both HOW and WN.

The above embodiments have been described by citing, as an example, an electronic wristwatch as an electronic device; however, the present invention is not limited to this. The present invention can also be applied to other electronic devices which obtain date and time information by receiving radio waves from GPS satellites in a short time such as an electronic pedometer, mobile type information terminal, mobile phone, smartphone, digital camera and car navigation device, for example.

Though the above embodiments have been described by taking, as an example, an electronic timepiece which performs digital display, the present invention may be applied to an analog display type electronic timepiece which uses hands.

Though the reception control is performed by the GPS reception processing unit 50 in the embodiment, all the processing may be performed by the CPU 41.

The above embodiments have been described by disclosing an example in which the ROM 42 is used as a computer readable medium storing a program according to the present invention; however, the present invention is not limited to the example. As other computer readable media, a portable recording medium such as a non-volatile memory including a flash memory, a SSD (Solid State Disk) and such like, an HDD (Hard Disk Drive), a CD-ROM and a USB memory can be applied. Also, as a medium providing program data according to the present invention via a communication line, carrier wave can also be applied to the present invention.

The other details such as specific configurations, numeral values and control procedures shown in the embodiments can be appropriately changed within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2013-268841 filed on Dec. 26, 2013 and Japanese Patent Application No. 2014-207038 filed on Oct. 8, 2014 including description, claims, drawings, and abstract are incorporated herein by reference in its entirety.

What is claimed is:

1. An electronic device, comprising:

a clocking unit which counts a date and time and a week;

a receiving unit which receives a transmitted radio wave from a positioning satellite;

a reception control unit which controls a reception period by the receiving unit; and a date and time obtaining unit which obtains a calculation date and time by calculating a date and time from the received transmitted radio wave, wherein the reception control unit makes the receiving unit receive first date and time information which is transmitted from the positioning satellite, the first date and time information indicating an elapsed time from a start of a week to an end of the week, wherein the reception control unit does not make the receiving unit receive second date and time information which is transmitted from the positioning satellite, the second date and time information indicating a week number, wherein the date and time obtaining unit calculates an uncorrected date and time based on the first date and time information and a clocking unit week number which is a week number calculated from the date and time counted by the clocking unit, and wherein the date and time obtaining unit obtains the calculation date and time by correcting the uncorrected date and time based on a difference between the uncorrected date and time and the date and time counted by the clocking unit.

2. The electronic device according to claim 1, wherein the date and time obtaining unit determines whether the difference is a predetermined width or more; and wherein when the difference is determined to be the predetermined width or more, the date and time obtaining unit obtains the calculation date and time by correcting the uncorrected date and time to a date and time shifted for one week in a direction opposite to a direction in which the uncorrected date and time is different from the date and time of the clocking unit.

3. The electronic device according to claim 2, wherein, when the uncorrected date and time is within a predetermined shift width from the start of the week or within the predetermined shift width from the end of the week, the date and time obtaining unit performs determination with a value as the predetermined width, the value being obtained by subtracting the shift width from a width of one week.

4. The electronic device according to claim 3, further comprising a date obtaining timing determination unit which determines whether an elapsed time from previous date and time obtaining is a predetermined period or more, the predetermined period being determined based on a clocking error of the clocking unit, wherein when the elapsed time is determined to be the predetermined period or more, the reception control unit makes the receiving unit receive both the first date and time information and the second date and time information, and the date and time obtaining unit obtains the calculation date and time by calculating a date and time from the first date and time information and the second date and time information which are received by the receiving unit.

5. The electronic device according to claim 3, wherein, when the difference between the uncorrected date and time calculated by the date and time obtaining unit and the date and time counted by the clocking unit is the predetermined width or more and less than a width obtained by subtracting the predetermined width from the width of one week, the date and time obtaining unit does not calculate the clocking unit week number from the date and time counted by the clocking unit.

6. The electronic device according to claim 2, wherein the first date and time information is representable by combining a value of a seconds unit with a value of a day unit, and wherein when a value of the day unit according to the uncorrected date and time is within a predetermined shift width from the start of the week or within the predetermined shift width from the end of the week, the date and time obtaining unit determines whether a difference between the value of the day unit according to the uncorrected date and time and a value of the day unit according to the date and the time counted by the clocking unit is a value or more, the value being obtained by subtracting the shift width from a width of one week.

7. The electronic device according to claim 6, further comprising a date obtaining timing determination unit which determines whether an elapsed time from previous date and time obtaining is a predetermined period or more, the predetermined period being determined based on a clocking error of the clocking unit, wherein when the elapsed time is determined to be the predetermined period or more, the reception control unit makes the receiving unit receive both the first date and time information and the second date and time information, and the date and time obtaining unit obtains the calculation date and time by calculating a date and time from the first date and time information and the second date and time information which are received by the receiving unit.

8. The electronic device according to claim 6, wherein, when the difference between the uncorrected date and time calculated by the date and time obtaining unit and the date and time counted by the clocking unit is the predetermined width or more and less than a width obtained by subtracting the predetermined width from the width of one week, the date and time obtaining unit does not calculate the clocking unit week number from the date and time counted by the clocking unit.

9. The electronic device according to claim 2, further comprising a date obtaining timing determination unit which determines whether an elapsed time from previous date and time obtaining is a predetermined period or more, the predetermined period being determined based on a clocking error of the clocking unit, wherein when the elapsed time is determined to be the predetermined period or more, the reception control unit makes the receiving unit receive both the first date and time information and the second date and time information, and the date and time obtaining unit obtains the calculation date and time by calculating a date and time from the first date and time information and the second date and time information which are received by the receiving unit.

10. The electronic device according to claim 2, wherein, when the difference between the uncorrected date and time calculated by the date and time obtaining unit and the date and time counted by the clocking unit is the predetermined width or more and less than a width obtained by subtracting the predetermined width from a width of one week, the date and time obtaining unit does not calculate the clocking unit week number from the date and time counted by the clocking unit.

11. The electronic device according to claim 2, wherein the positioning satellite is a GPS satellite, the reception control unit makes the receiving unit receive HOW as the first date and time information, and the date and time obtaining unit calculates, as the uncorrected date and time, a value according to WN from the date and time of the clocking unit.

12. The electronic device according to claim 1, further comprising a date obtaining timing determination unit which determines whether an elapsed time from previous date and time obtaining is a predetermined period or more, the predetermined period being determined based on a clocking error of the clocking unit, wherein when the elapsed time is determined to be the predetermined period or more, the reception control unit makes the receiving unit receive both the first date and time information and the second date and time information, and the date and time obtaining unit obtains the calculation date and time by calculating a date and time from the first date and time information and the second date and time information which are received by the receiving unit.

13. The electronic device according to claim 12, further comprising a history storage unit which stores a history according to date and time obtaining by the date and time obtaining unit, wherein the date obtaining timing determination unit determines whether the elapsed time is the predetermined period or more by referring to the stored history.

14. The electronic device according to claim 1, wherein the positioning satellite is a GPS satellite, the reception control unit makes the receiving unit receive HOW as the first date and time information, and the date and time obtaining unit calculates, as the uncorrected date and time, a value according to WN from the date and time of the clocking unit.

15. The electronic device according to claim 14, wherein the first date and time information is representable by combining a value of a seconds unit with a value of a day unit, wherein when a day-of-week according to the uncorrected date and time is Sunday or Saturday, the date and time obtaining unit determines whether a difference between a date of the uncorrected date and time and a date of the date and time counted by the clocking unit is 6 days or more, and wherein when the difference between the date of the uncorrected date and time calculated by the date and time obtaining unit and the date of the date and time counted by the clocking unit is in a range of 2 days or more and less than 6 days, the reception control unit operates the receiving unit again to receive both the first date and time information and the second date and time information.

16. The electronic device according to claim 14, wherein the first date and time information is representable by combining a value of a seconds unit with a value of a day unit, wherein the date and time obtaining unit calculates the uncorrected date and time based on a timepiece mounted on the GPS satellite, wherein the date and time obtaining unit performs, by a date and time based on a timepiece according to input and output with the clocking unit, comparison with the date and time counted by the clocking unit and correction of the uncorrected date and time, wherein when a day-of-week according to the uncorrected date and time is Sunday or Saturday, the date and time obtaining unit determines whether a difference between a date of the uncorrected date and time and a date of the date and time counted by the clocking unit is 6 days or more, and wherein when the difference between the date of the uncorrected date and time and the date of the date and time counted by the clocking unit is in a range of 2 days or more and less than 6 days, the reception control unit operates the receiving unit again to receive both the first date and time information and the second date and time information.

17. The electronic device according to claim 16, wherein a difference between the date and time counted by the timepiece mounted on the GPS satellite and the date and time counted by the timepiece according to the input and the output with the clocking unit is determined based on an implementation state of a leap second.

18. The electronic device according to claim 1, further comprising:

a display unit which is capable of displaying a date and time; and a display control unit which controls an operation of the display unit.

19. A non-transitory computer readable recording medium storing a program that makes a computer, which includes a clocking unit that counts a date and time and a week and a receiving unit that receives a transmitted radio wave from a positioning satellite, operate as:

a reception control unit which controls a reception period by the receiving unit; and a date and time obtaining unit which obtains a calculation date and time by calculating a date and time from the received transmitted radio wave, wherein the reception control unit makes the receiving unit receive first date and time information which is transmitted from the positioning satellite, the first date and time information indicating an elapsed time from a start of a week to an end of the week, wherein the reception control unit does not make the receiving unit receive second date and time information which is transmitted from the positioning satellite, the second date and time information indicating a week number, wherein the date and time obtaining unit calculates an uncorrected date and time based on the first date and time information and a clocking unit week number which is a week number calculated from the date and time counted by the clocking unit, and wherein the date and time obtaining unit obtains the calculation date and time by correcting the uncorrected date and time based on a difference between the uncorrected data and time and the data and time counted by the clocking unit.

20. A date and time information obtaining method using a clocking unit which counts a date and time and a week and a receiving unit which receives a transmitted radio wave from a positioning satellite, the method comprising:

controlling a reception period by the receiving unit; and obtaining a calculation date and time by calculating a date and time from the received transmitted radio wave, wherein the receiving unit is made to receive first date and time information which is transmitted from the positioning satellite, the first date and time information indicating an elapsed time from a start of a week to an end of the week, wherein the receiving unit is made not to receive second date and time information which is transmitted from the positioning satellite, the second date and time information indicating a week number, and wherein the obtaining includes:

calculating an uncorrected date and time based on the first date and time information and a clocking unit week number which is a week number calculated from the date and time counted by the clocking unit, and obtaining the calculation date and time by correcting the uncorrected date and time based on a difference between the uncorrected date and time and the date and time counted by the clocking unit.

* * * * *